US007294033B1

(12) United States Patent
Chen et al.

(10) Patent No.: US 7,294,033 B1
(45) Date of Patent: Nov. 13, 2007

(54) METHOD FOR FABRICATING LUMINESCENT SOLID KEY

(75) Inventors: Li-Sen Chen, Gueishan Township, Taoyuan County (TW); Lu-Chin Wu, Gueishan Township, Taoyuan County (TW)

(73) Assignee: Speed Tech Corp., Taoyuan County (TW)

( * ) Notice: Subject to any disclaimer, the term of this patent is extended or adjusted under 35 U.S.C. 154(b) by 73 days.

(21) Appl. No.: 11/416,164

(22) Filed: May 3, 2006

(51) Int. Cl.
*H01H 11/00* (2006.01)

(52) U.S. Cl. ..... 445/24; 29/622; 345/170

(58) Field of Classification Search ..... None
See application file for complete search history.

(56) References Cited

U.S. PATENT DOCUMENTS

| | | | | |
|---|---|---|---|---|
| 3,934,244 | A * | 1/1976 | Mueller | 345/170 |
| 5,340,955 | A * | 8/1994 | Calvillo et al. | 200/302.2 |
| 5,797,482 | A * | 8/1998 | LaPointe et al. | 200/314 |
| 6,075,316 | A * | 6/2000 | Shi et al. | 313/504 |
| 6,100,478 | A * | 8/2000 | LaPointe et al. | 200/314 |
| 6,806,815 | B1 * | 10/2004 | Kaikuranta et al. | 341/22 |
| 7,005,595 | B1 * | 2/2006 | Tang | 200/310 |
| 7,242,392 | B2 * | 7/2007 | Han et al. | 345/170 |

* cited by examiner

*Primary Examiner*—Evan Pert
(74) *Attorney, Agent, or Firm*—Troxell Law Office, PLLC

(57) ABSTRACT

A method for making a luminescent key. The key has a 3-dimensional shape and is extraordinarily thin. Besides, the key evenly emits luminescence. The key can be used in a mobile phone to save space so that more components can be put in to the mobile phone.

20 Claims, 10 Drawing Sheets

METHOD FOR FABRICATING LUMINESCENT SOLID KEY

FIELD OF THE INVENTION

The present invention relates to fabricating a pressing key; more particularly, relates to fabricating a luminescent solid key.

DESCRIPTION OF THE RELATED ART(S)

A general handheld device in the 3C (Computer, Communication and Consumer Electronics) field relies much of its functions and appearance on the pressing keys. The keys are required for operating and controlling the functions of a 3C device and for making its appearance beautiful. Therefore, the keys play an important part both in its functions and in its appearance.

A key for a general handheld device is usually fabricated in two ways: one is to inject plastic material into a mold to obtain a base with keys on it; the other is to inject plastic material into a mold to obtain a plurality of single keys to be set on a base.

The key fabricated through either of the above two methods is coordinated with a mold so that a certain thickness is formed. As long as the functions of a mobile phone increase day by day, more components have to be put into a limited space so that a pressing key has to become thinner. Yet, as is said, no matter whether the key is deposed on an EL (Electro-Luminescent) film or is made of a LED (Light Emitting Diode), a certain thickness (about 0.8 millimeter) is required, where thinness is deprived and cost lies together with a complex procedure. Hence, the prior arts do not fulfill users' requests on actual use.

SUMMARY OF THE INVENTION

The main purpose of the present invention is to fabricate a luminescent solid key with thinness and even luminescence while saving cost and procedure.

To achieve the above purpose, the present invention is a method for fabricating a luminescent solid key, comprising steps of obtaining a substrate having a base, an image layer, a first conductive layer, a light-emitting layer, a dielectric layer, a second conductive layer and an insulation layer sequentially; pre-shaping the substrate; obtaining a pressing layer having a plurality of contacting units on the insulation layer; and cutting the substrate to obtain at least one lightening solid key. Accordingly, a novel method for fabricating a luminescent solid key is obtained.

BRIEF DESCRIPTIONS OF THE DRAWINGS

Figure 1:
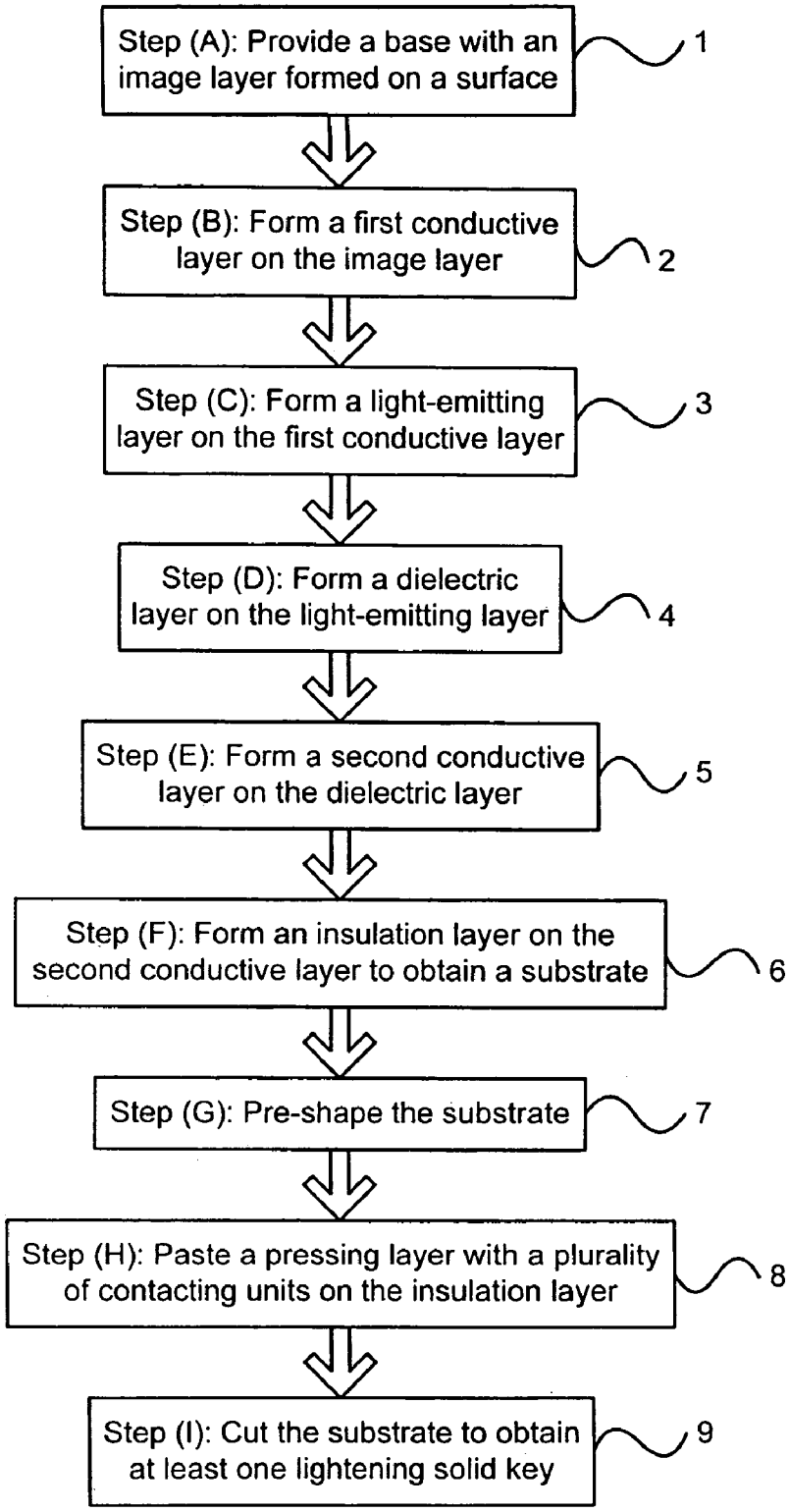

The present invention will be better understood from the following detailed description of the preferred embodiment according to the present invention, taken in conjunction with the accompanying drawings in which FIG. 1 is a view showing the flow chart of the preferred embodiment according to the present invention;

FIG. 2 to FIG. 10 are cross-sectional views showing the products after step (A) to step (I) of the preferred embodiment.

DESCRIPTION OF THE PREFERRED EMBODIMENT

The following description of the preferred embodiment is provided to understand the features and the structures of the present invention. Please refer to FIG. 1, which is a view showing the flow chart of the preferred embodiment according to the present invention. As shown in the figure, the present invention is a method for fabricating a luminescent solid key, comprising the following steps:

Step (A): A base is provided; and, an image layer is formed on a surface of the base.

Step (B): A first conductive layer is formed on the image layer.

Step (C): A light-emitting layer is formed on the first conductive layer.

Step (D): A dielectric layer is formed on the light-emitting layer.

Step (E): A second conductive layer is formed on the dielectric layer.

Step (F): An insulation layer is formed on the second conductive layer so that a substrate, sequentially having the base, the image layer, the first conductive layer, the light-emitting layer, the dielectric layer, the second conductive layer and the insulation layer, is obtained.

Step (G): The substrate is pre-shaped.

Step (H): A pressing layer having a plurality of contacting units is formed on the insulation layer of the substrate.

Step (I): Finally the substrate is cut to obtain at least one lightening solid key.

Thus, with the above steps, a novel method for fabricating a luminescent solid key is obtained.

Figure 2:
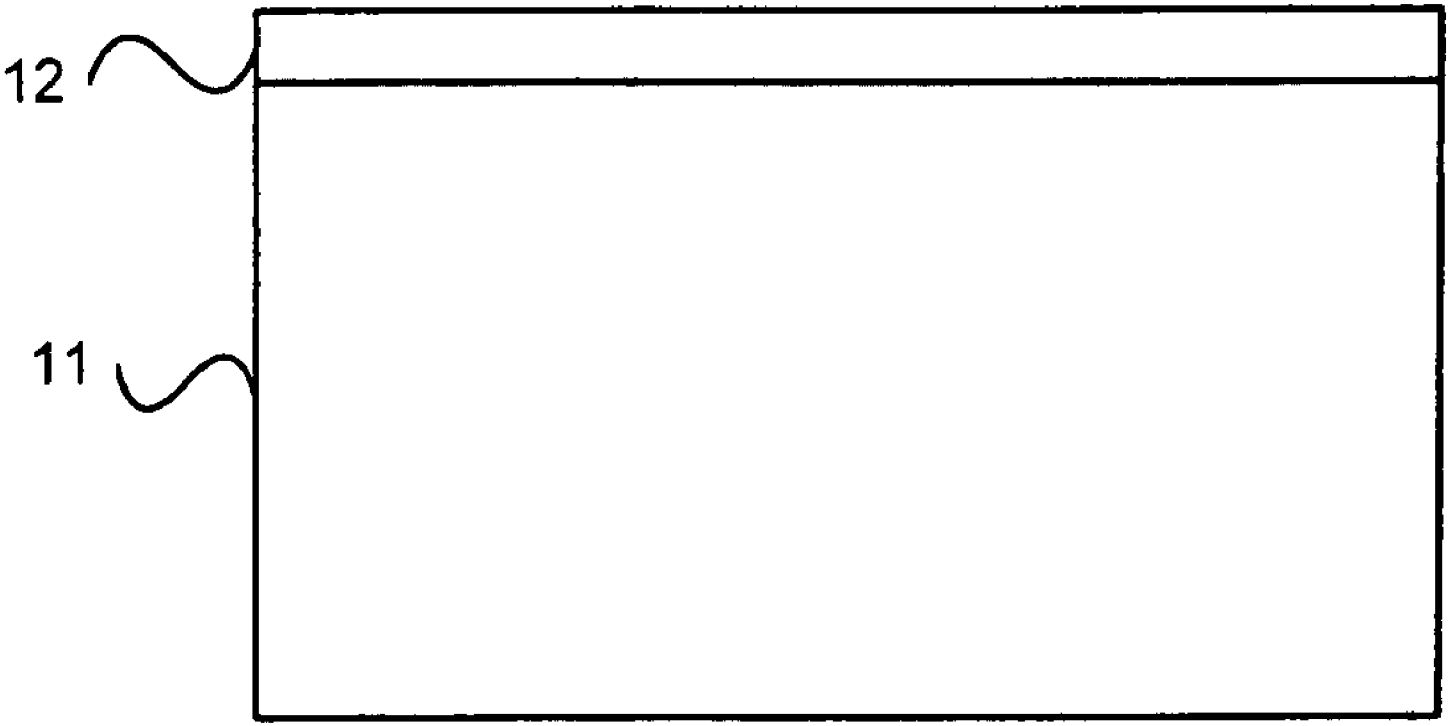

Please refer to FIG. 2, which is a cross-sectional view showing the product after step (A) of the preferred embodiment. As shown in the figure, in step (A), a base 11 is provided with a thickness between 0.05 millimeter (mm) and 0.30 mm, which is made a transparent material of Polycarbonate (PC), Polymethylmethacrylate (PMMA), Polyurethane (PU), Polyethylene Terephthalate (PET), Polybutylene Terephthalate (PBT) or Acrylonitrile Butadiene Styrene (ABS). And an image layer 12 is deposed on the base 11, where the image layer is made of PC, PMMA, PU, epoxy or polyester; the image layer has a thickness between 0.1 mm and 0.2 mm; and the image layer is printed with a colorful image through a chromolithography by using a printing ink mixed with a fluorescent powder.

Figure 3:
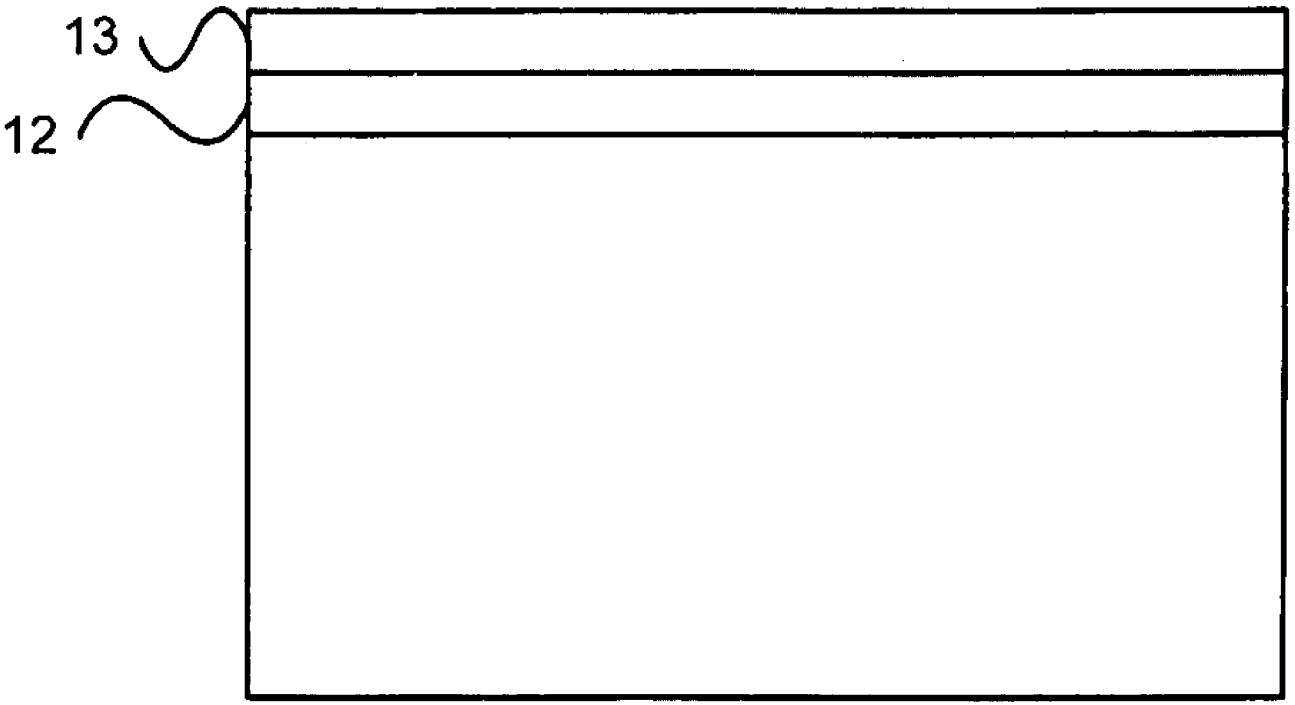

Please further refer to FIG. 3, which is a cross-sectional view showing the product after step (B).

As shown in the figure, a first conductive layer 13 is printed on the image layer 12, where the first conductive layer 13 has a thickness between 0.01 mm and 0.2 mm; and the first conductive layer 13 is connected with an electrode (not shown in the figure) to conduct a current.

Figure 4:
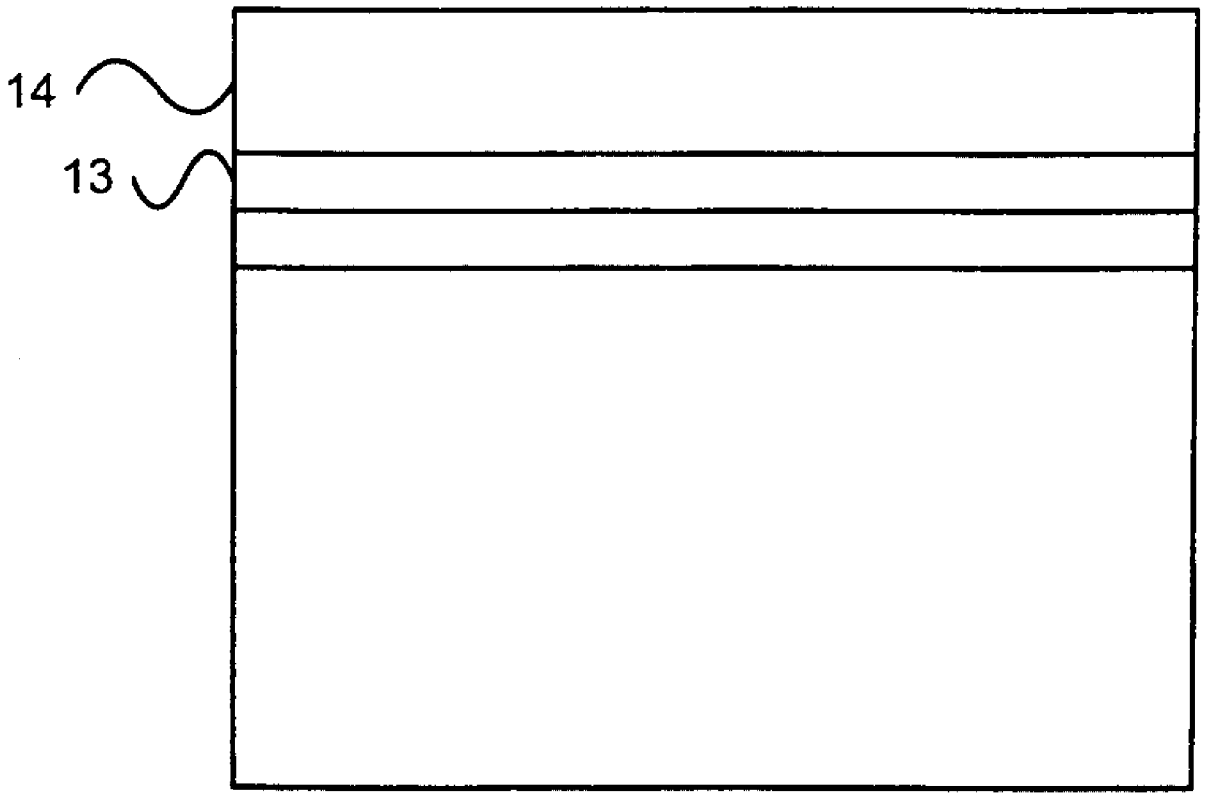

Please further refer to FIG. 4, which is a cross-sectional view showing the product after step (C). As shown in the figure, in step (C), a light-emitting layer 14 is printed on the first conductive layer 13, where the light-emitting layer 14 is made of an electroluminescence fluorescent powder having a thickness between 0.02 mm and 0.2 mm.

Figure 5:
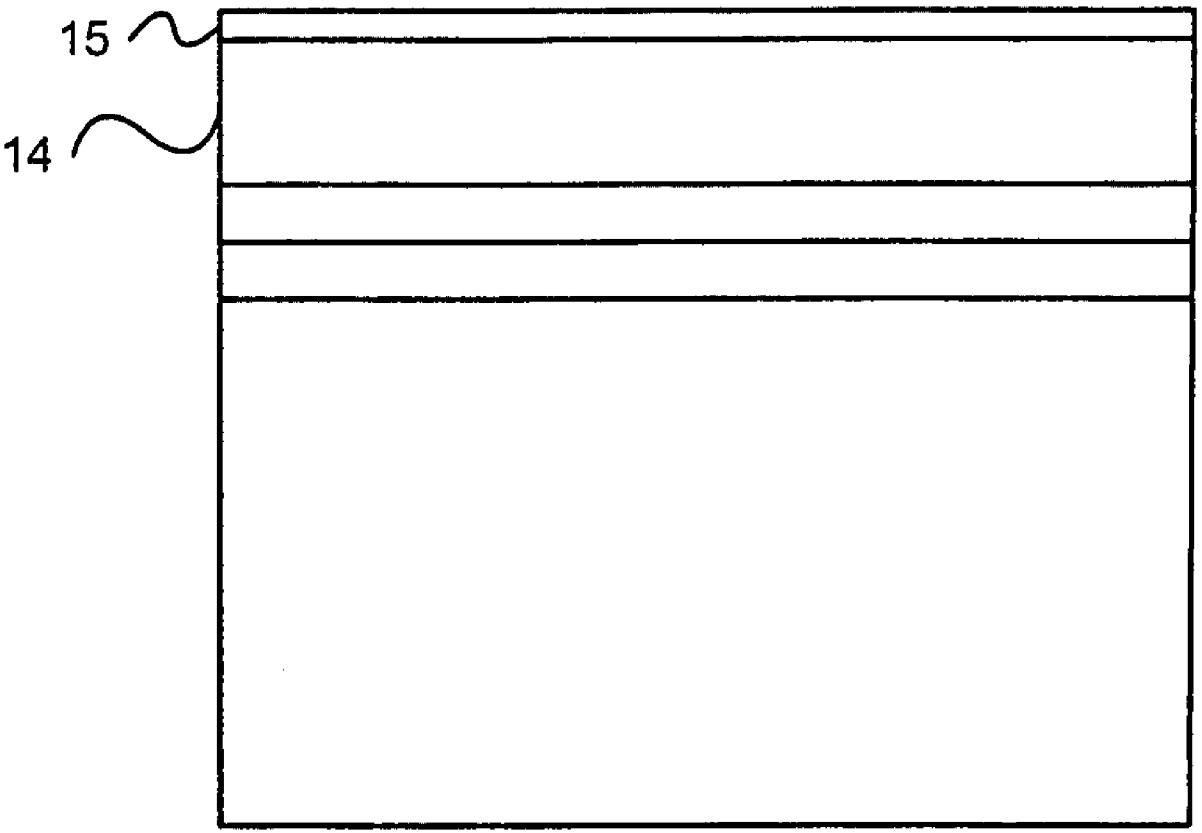

Please further refer to FIG. 5, which is a cross-sectional view showing the product after step (D). As shown in the figure, in step (D), a dielectric layer 15 is printed on the light-emitting layer 14, where the dielectric layer 15 is made of barium titanate ($BaTiO_3$) with a thickness between 0.001 mm and 0.1 mm.

Figure 6:
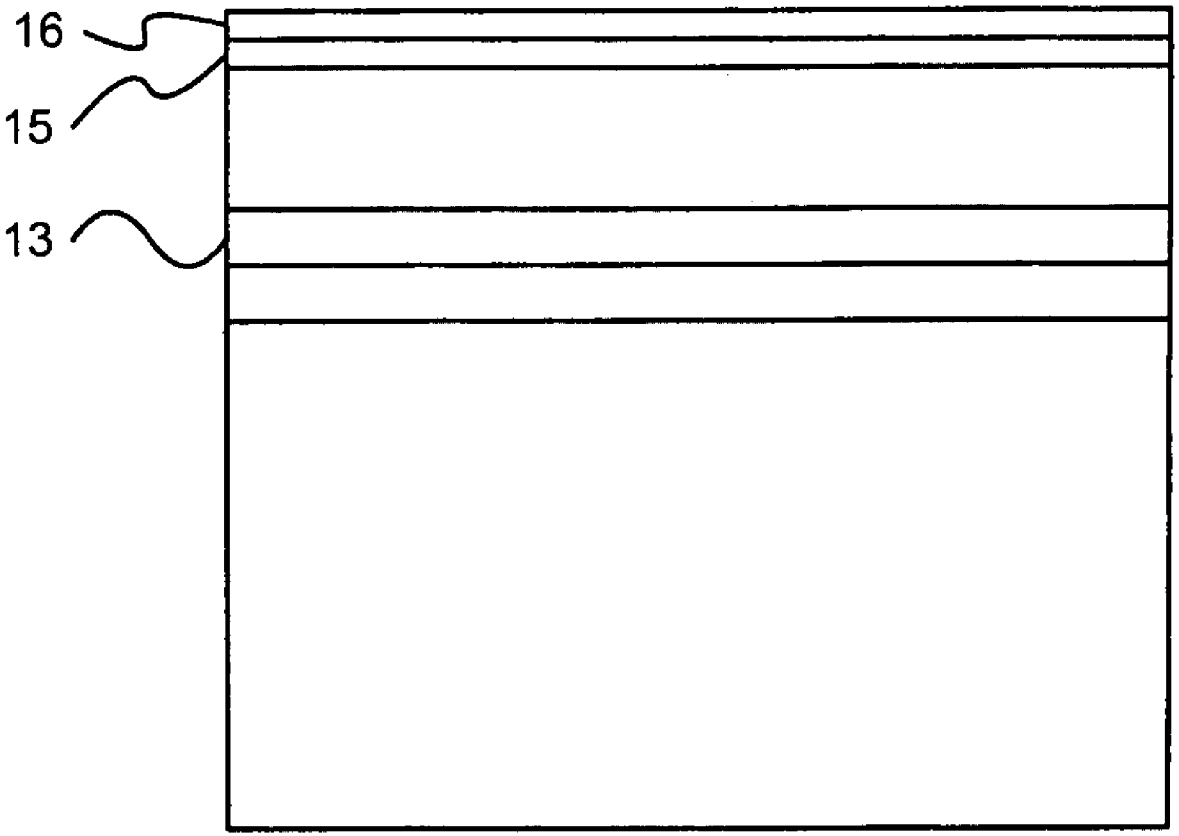

Please further refer to FIG. 6, which is a cross-sectional view showing the product after step (E). As shown in the figure, in step (E), a second conductive layer 16 is printed on the dielectric layer 15, where the second conductive layer 16 is made of a conductive printing ink of a conductive silver paste or a conductive carbon black, having a thickness between 0.001 mm and 0.2 mm. The second conductive layer is connected with an electrode (not shown in the figure) to conduct a current coordinated with the first conductive layer 13.

Figure 7:
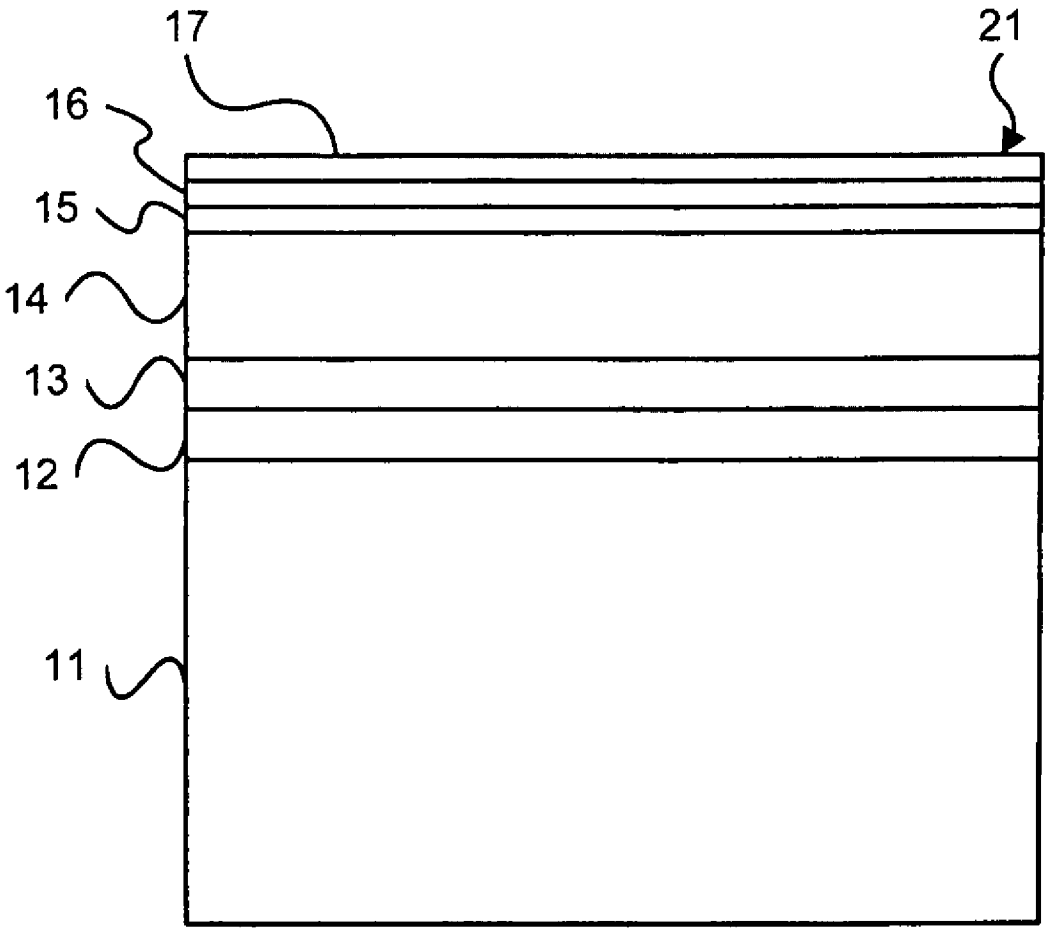

Please further refer to FIG. 7, which is a cross-sectional view showing the product after step (F). As shown in the figure, in step (F), an insulation layer 17 is printed on the second conductive layer 16, where the insulation layer 17 is made of an insulation ink of PC, PMMA, PU, silicon, epoxy or polyester having a thickness between 0.001 mm and 0.1 mm. After step (F), a substrate 21, having the base 11, the image layer 12, the first conductive layer 13, the light-emitting layer 14, the dielectric layer 15, the second conductive layer 16 and the insulation layer 17, is obtained.

Figure 8:
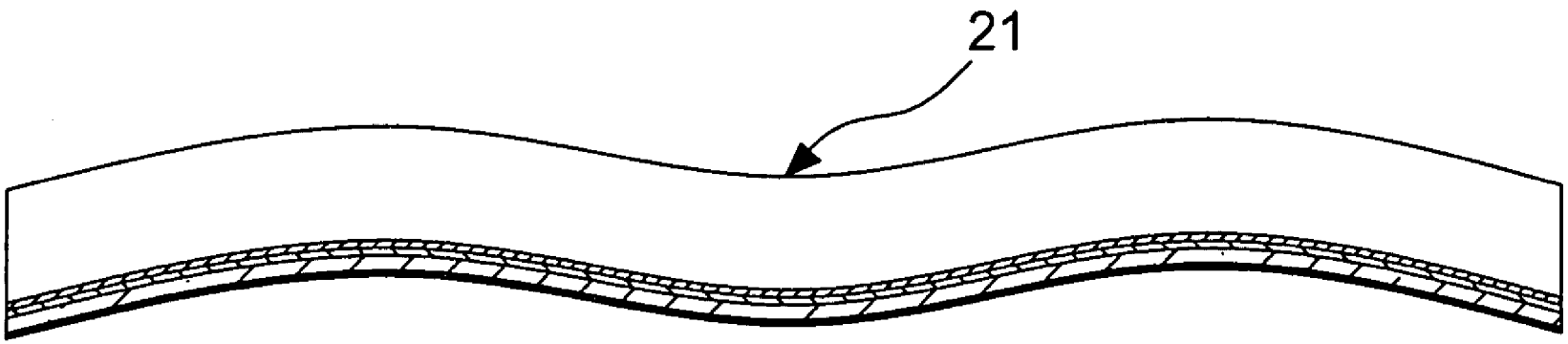

Please refer to FIG. 8, which is a cross-sectional view showing the product after step (G). As shown in the figure, in step (G), the substrate 21 obtained after step (F), as shown in FIG. 7, is stretched to obtain a plate having a thickness between 0.05 mm and 0.50 mm; or obtains a perspective convex shape through a mold with a forming machine. Thus the substrate 21 is pre-shaped.

Figure 9:
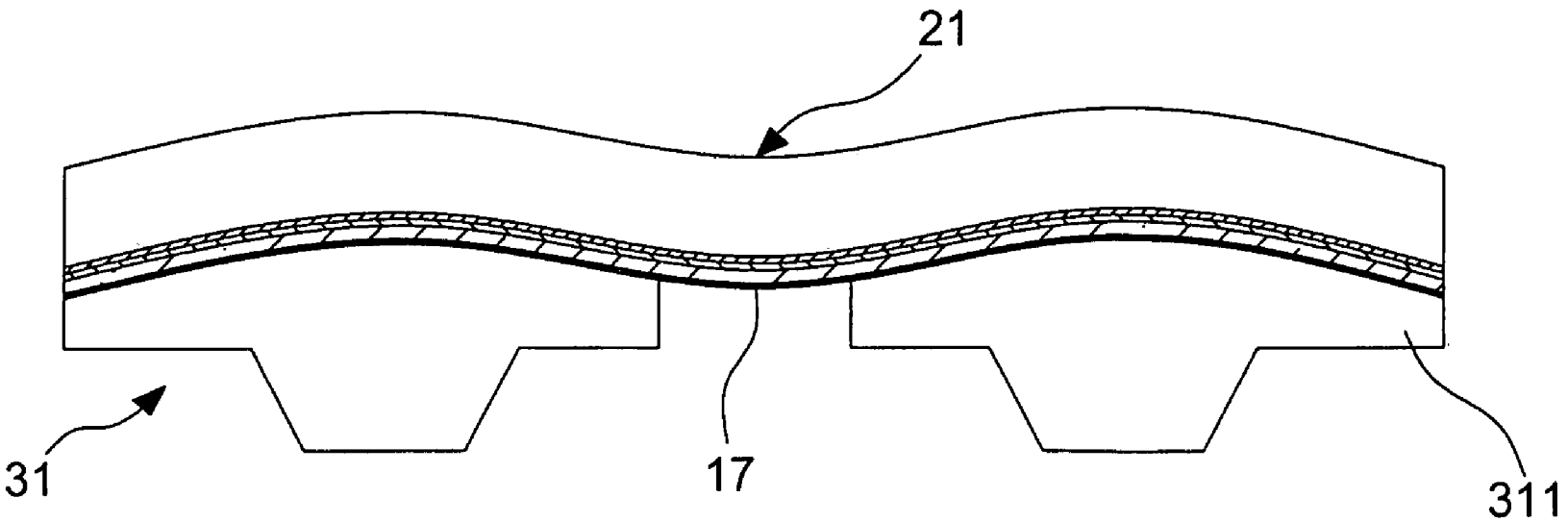

Please refer to FIG. 9, which is a cross-sectional view showing the product after step (H). As shown in the figure, in step (H), a pressing layer 31 having a plurality of contacting units 311 is pasted on the insulation layer 17 of the substrate 21 obtained after step (F), as shown in FIG. 8, where the pressing layer 31 is made of a soft plastic or a soft rubber, which is Thermoplastic Urethane (TPU), Thermal Plastic Rubber (TPR) or Thermoplastic Elastomer (TPE), having a thickness between 0.05 mm and 0.4 mm through pouring, pressing and Injecting with the soft plastic or the soft rubber.

Figure 10:
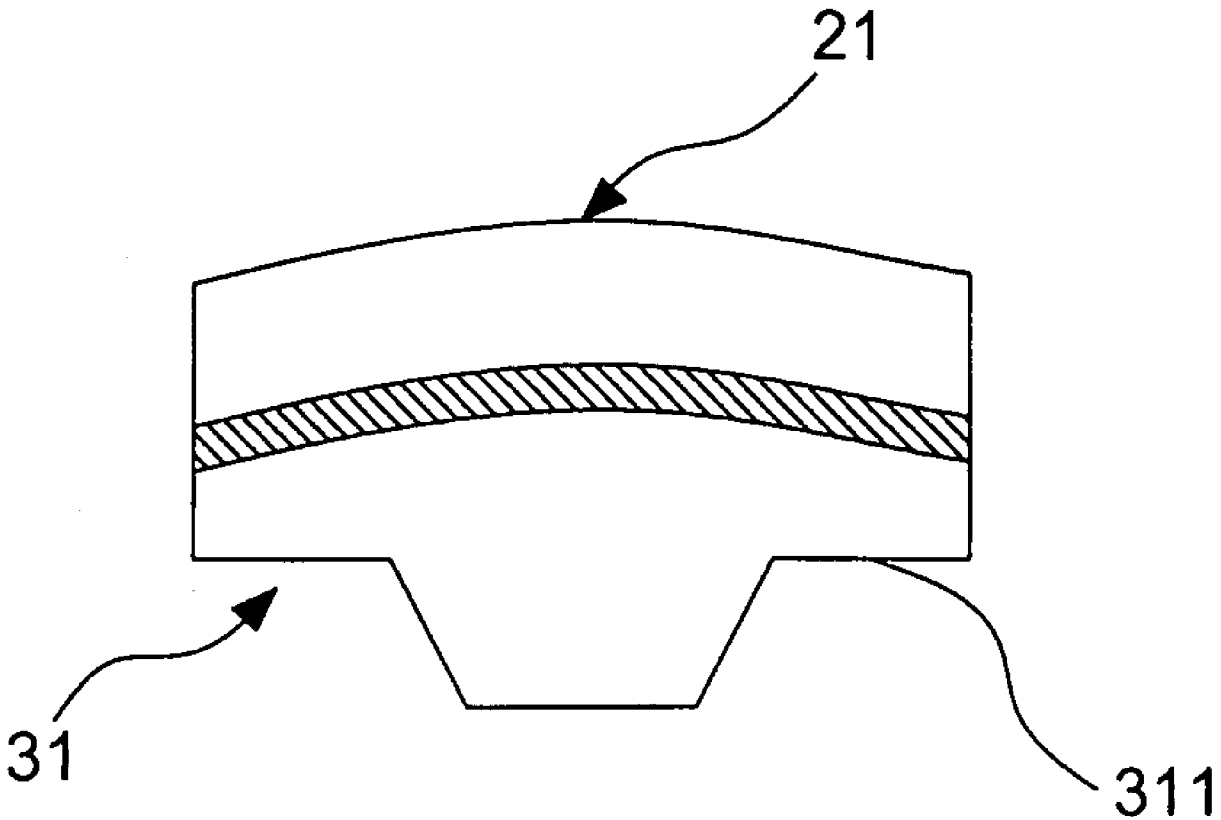

Please refer to FIG. 10, which is a cross-sectional view showing the product after step (I). As shown in the figure, in step (I), the substrate 21 obtained after step (G), as shown in FIG. 9, is cut by a laser marking, a Computer Numerically Controlled (CNC) cutting and a punching so that a lightening solid key is obtained according to a requirement.

As a result, the present invention has the following characteristics:

1. The substrate can be extraordinarily thin. A film for preventing the fluorescent powder from getting wet is replaced with the film of the pressing key directly so that a thickness of a film layer is saved. Besides, the thickness of the film of the pressing key can be thicker than the original film used so that the wetness prevention can be better.

2. The shape is convex so that the luminescence obtained is even. Because the film of the pressing key is used as a base, the film can be fabricated into a solid form. In such a way, the base can be stretched more easily than a general light-emitting film to be fabricated for a wider application.

3. The pressing keys can be rapidly and massively produced.

4. The cost and procedure can be saved. The present invention combines the original two processes for making a pressing key into a whole one process so that the cost is saved at the same time.

To sum up, the present invention is a method for fabricating a luminescent solid key, combining a pressing key and a film, where a luminescent solid key obtained is extraordinarily thin and the luminescence the key emitted is even.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A method for fabricating a luminescent solid key, comprising steps of:

(A) providing a base with an image layer on a surface of said base;

(B) obtaining a first conductive layer on said image layer;

(C) obtaining a light-emitting layer on said first conductive layer;

(D) obtaining a dielectric layer on said light-emitting layer;

(E) obtaining a second conductive layer on said dielectric layer;

(F) obtaining an insulation layer on said second conductive layer to obtain a substrate sequentially having said base, said image layer, said first conductive layer, said light-emitting layer, said dielectric layer, said second conductive layer and said insulation layer;

(G) pre-shaping said substrate;

(H) obtaining a pressing layer on said insulation layer of said substrate, said pressing layer having a plurality of contacting units; and (I) cutting said substrate to obtain at least one lightening solid key.

2. The method according to claim 1, wherein said base is a transparent plastic film having a thickness between 0.05 millimeter (mm) and 0.30 mm.

3. The method according to claim 1, wherein said base is selected from a group consisting of Polycarbonate (PC), Polymethylmethacrylate (PMMA), Polyurethane (PU), Polyethylene Terephthalate (PET), Polybutylene Terephthalate (PBT) and Acrylonitrile Butadiene Styrene (ABS).

4. The method according to claim 1, wherein said image layer has a thickness between 0.01 mm and 0.2 mm.

5. The method according to claim 1, wherein said image layer is made of a printing ink mixed with a fluorescent powder; and wherein said printing ink is made of a material selected from a group consisting of PC, PMMA, PU, epoxy and polyester.

6. The method according to claim 1, wherein said image layer is printed with an image through a chromolithography.

7. The method according to claim 1, wherein said first conductive layer has a thickness between 0.01 mm and 0.1 mm.

8. The method according to claim 1, wherein said light-emitting layer has a thickness between 0.02 mm and 0.2 mm.

9. The method according to claim 1, wherein said light-emitting layer is made of an electroluminescence fluorescent powder.

10. The method according to claim 1, wherein said dielectric layer has a thickness between 0.001 mm and 0.1 mm.

11. The method according to claim 1, wherein said dielectric layer is made of barium titanate ($BaTiO_3$).

12. The method according to claim 1, wherein said second conductive layer has a thickness between 0.001 mm and 0.2 mm.

13. The method according to claim, 1 wherein said second conductive layer is made of a conductive printing ink; and wherein said conductive printing ink is made of a material selected from a group consisting of a conductive silver paste and a conductive carbon black.

14. The method according to claim 1, wherein said insulation layer has a thickness between 0.001 mm and 0.1 mm.

15. The method according to claim 1, wherein said insulation layer is made of an insulation ink selected from a group consisting of PC, PMMA, PU, silicon, epoxy and polyester.

16. The method according to claim 1, wherein said substrate pre-shaped has a thickness between 0.05 mm and 0.50 mm.

17. The method according to claim 1, wherein after pre-shaping said substrate, said substrate obtains a perspective convex shape through a mold with a forming machine.

18. The method according to claim 1, wherein said pressing layer is made of a material selected from a group consisting of a soft plastic and a soft rubber;

wherein said pressing layer is made of a material selected from a group consisting of Thermoplastic Urethane (TPU), Thermal Plastic Rubber (TPR) and Thermoplastic Elastomer (TPE); and wherein said pressing layer is made through a method selected from a group consisting of pouring pressing and Injecting with said material.

19. The method according to claim 1, wherein said pressing layer has a thickness between 0.05 mm and 0.4 mm.

20. The method according to claim 1, wherein said substrate is cut by using a method selected from a laser marking, a Computer Numerically Controlled (CNC) cutting and a punching.

* * * * *